United States Patent [19]

Jimerson et al.

[11] 4,117,377

[45] Sep. 26, 1978

[54] CIRCUITS FOR STARTING AND OPERATING IONIZED GAS LAMPS

[76] Inventors: Bruce D. Jimerson, 2131 Grenadier Dr., San Pedro, Calif. 90732; Henry H. Nakasone, 1672 Camrose Way, Anaheim, Calif. 92802

[21] Appl. No.: 648,909

[22] Filed: Jan. 14, 1976

[51] Int. Cl.[2] ..... H05B 37/02; H05B 39/04; H05B 41/36

[52] U.S. Cl. ..... 315/209 R; 315/DIG. 5; 315/DIG. 7; 315/227 R; 315/232; 315/205; 315/101

[58] Field of Search ..... 315/DIG. 5, DIG. 7, 315/227, 228, 229, 230, 232, 205, 101, 240, 273

[56] References Cited

U.S. PATENT DOCUMENTS

| | | | |
|---|---|---|---|
| 3,353,062 | 11/1967 | Nuckolls | 315/205 X |
| 3,619,713 | 11/1971 | Biega et al. | 315/101 |
| 3,643,127 | 2/1972 | Laupman | 315/205 |
| 3,644,780 | 2/1972 | Koyama et al. | 315/101 |
| 3,836,817 | 9/1974 | Tchang et al. | 315/240 |
| 3,889,152 | 6/1975 | Bodine, Jr. et al. | 315/DIG. 5 |
| 3,913,002 | 10/1975 | Steigerwald et al. | 315/208 |
| 3,931,544 | 1/1976 | Pitel | 315/240 |

*Primary Examiner*—Saxfield Chatmon, Jr.

[57] ABSTRACT

The specification discloses a low loss ballast system for reducing the electrical power required to operate fluorescent and other ionized gas lamps as well as several unique starting and operating circuits which can be used in combination with conventional as well as the low loss system described herein.

9 Claims, 5 Drawing Figures

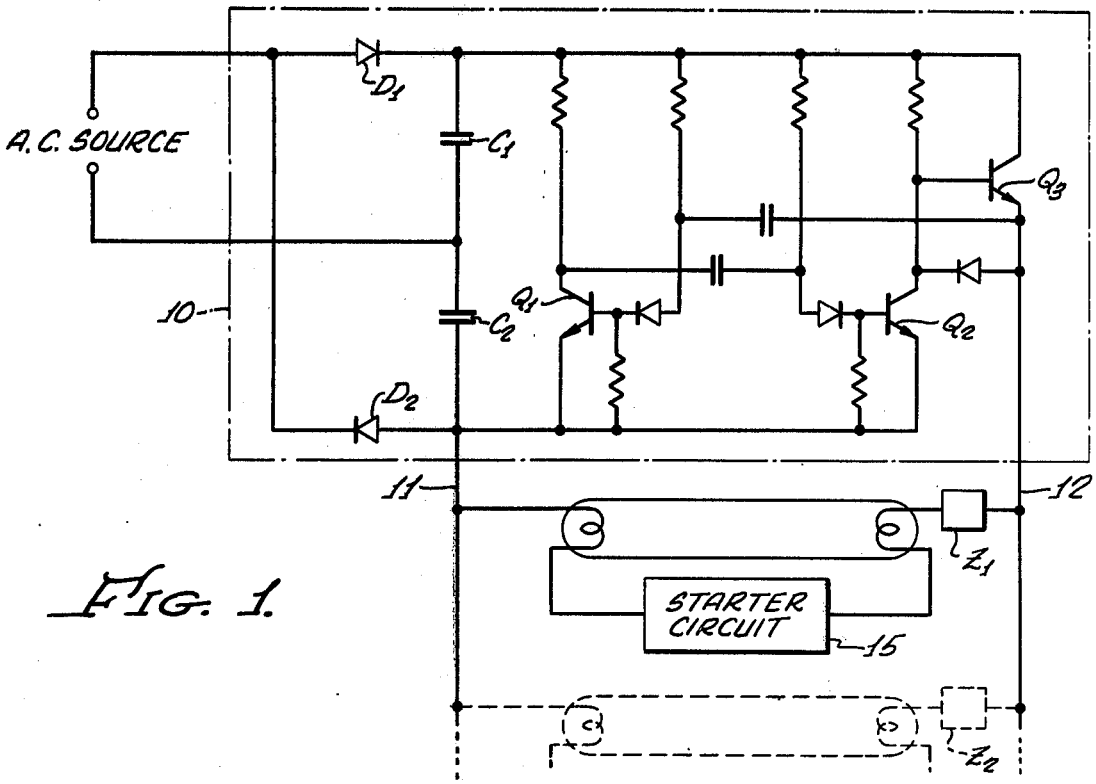
FIG. 1.
FIG. 2.
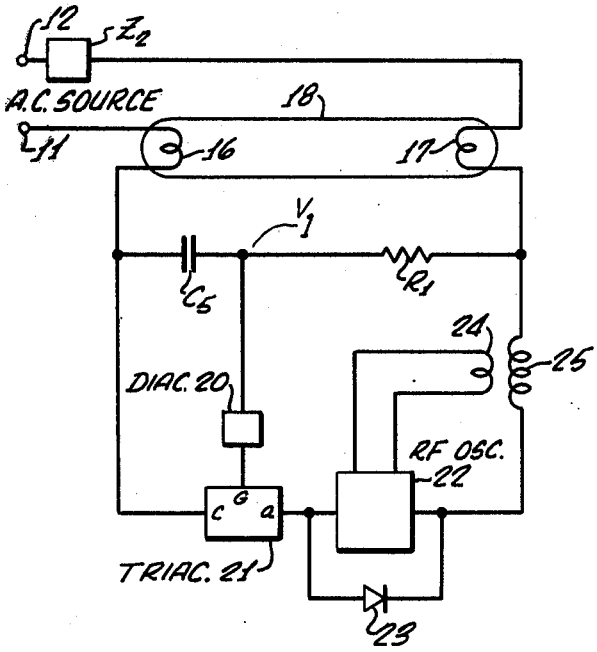
FIG. 3.
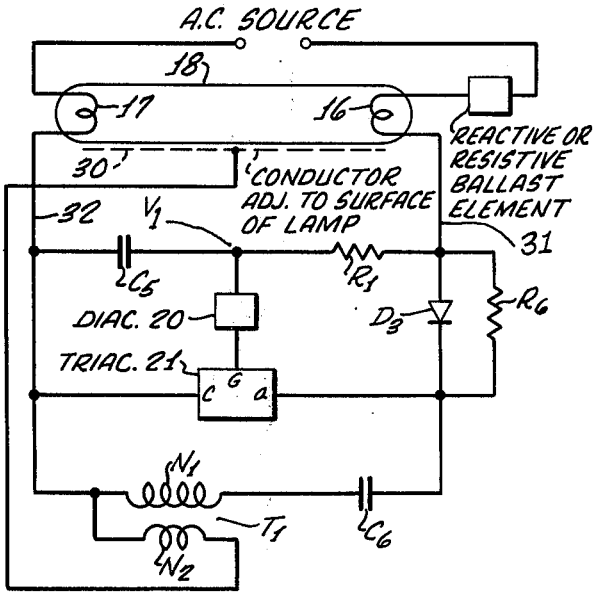

CIRCUITS FOR STARTING AND OPERATING IONIZED GAS LAMPS

BACKGROUND OF THE INVENTION

Reference is made to patent application Ser. No. 535,496, now abandoned, entitled "Apparatus For Operating a Fluorescent Lamp" the contents of which are incorporated herein by reference as additional background information.

Almost all commercial and industrial facilities utilize fluorescent lighting. Compared to an incandescent lamp, a fluorescent offers a far greater degree of efficiency. For an equivalent power rating, a fluorescent tube will develop five to six times the luminosity. Moreover, even using conventional heated filament starting circuits, the lifetime of a typical fluorescent lamp is approximately eight times that of an incandescent bulb.

A fluorescent lamp is an electric discharge light source. It consists of a phosphor coated glass tube with a cathode sealed in each end. Before the tube is sealed, the air is exhausted from it. Then small quantities of an inert gas mixture and a small amount of mercury are introduced. When the mercury is ionized as the result of an electrical potential ultra-violet radiation is produced. The ultra-violet radiation causes the phosphor coated walls to emit light.

Although there are a number of different types of fluorescent lamps and operating circuits, most commercial and industrial lighting systems in the United States employ a transformer type ballast which preheats the filament to facilitate starting. Accordingly, the advantages of the present invention will be described by comparison with such systems which are commonly referred to as rapid start types.

In a typical rapid start installation, a number of ballast transformers are connected in parallel across a single electrical circuit. Each ballast transformer operates one of two fluorescent tubes (depending upon the transformer design). The standard ballast transformer comprises a pair of windings for heating the filament and a "step up" secondary which is purposely designed to have a large leakage inductance. It serves the multiple function of, (1) raising the voltage to strike the arc, and (2) limiting the lamp operating current after ignition takes place (the large leakage inductance being equivalent to a series choke once the lamp is started), and (3) heating the filaments to aid in starting. These ballast have several disadvantages, namely:

1. Ballast transformers are heavy and relatively expensive in terms of the other components (e.g., the fluorescent tubes and fixtures).

2. Leak transformers are inefficient —approx. 20% of the applied power is lost in the form of heat which must be removed by the buildings'air conditioning system.

3. Although the filament windings are only used to facilitate starting, power is continuously applied to these elements as long as the lamp is operated—thus producing an additional heat loss.

As previously stated, fluorescent lamps are considerably more efficient than incandescent bulbs. Yet because of the tremendous number of such bulbs in commercial and industrial use, the total power consumption attributable to such lights is a relatively high percentage of the overall electrical energy consumption.* In view of the fact that the projected demands for electrical energy exceed the nation's ability to produce this form of power, the importance of increased commercial and industrial lighting efficiency will be readily appreciated.

* According to a three volumn Rand Study entitled "California Electricity Quandary" commercial lighting may consume as much as 37% of the state's electricity.

Accordingly, a primary object of the present invention is to provide a more efficient system for operating fluorescent lamps.

A further object of the present invention is to provide a fluorescent lighting system which does not require a transformer to step-up the voltage.

Another object of the invention is to provide a starting arrangement which does not utilize continuously heated filaments.

Another object of the present invention is to provide a non-inductive ballast system for operating a plurality of fluorescent lamps from a single source.

An additional object of the present invention is to provide novel means for starting fluorescent lamps which does not employ conventional step-up transformers or inductive kick ballasts.

Other objects and advantages of the present invention will be obvious from the detailed description of a preferred embodiment given herein below.

SUMMARY OF THE INVENTION

The aforementioned objects are realized by the present invention which comprises a capacitive doubler, the output of which is chopped to produce a square wave having a frequency in excess of ten times the main frequency. The output of the chopper is coupled to one or more ionized gas lamps via a series reactance. Starting of cold cathode lamps may be effected by a series resonant circuit, or a series RF generator which is automatically disabled once ignition occurs. Heated filament lamps may be started by a triac which functions to short circuit the filaments during one polarity of the input while generating a high surface potential adjacent to the lamp during the opposite polarity input.

DESCRIPTION OF THE DRAWINGS

FIG. 1 shows an embodiment of the invention which utilizes a voltage doubler and chopper to eliminate the necessity of a conventional inductive choke when operating from a 60 cps source.

FIG. 2 shows how a semiconductor switch can be used to turn "on" an RF oscillator when the filaments are short circuited to effect heating.

FIG. 3 shows a preferred embodiment of a general purpose starter.

Figure 4:
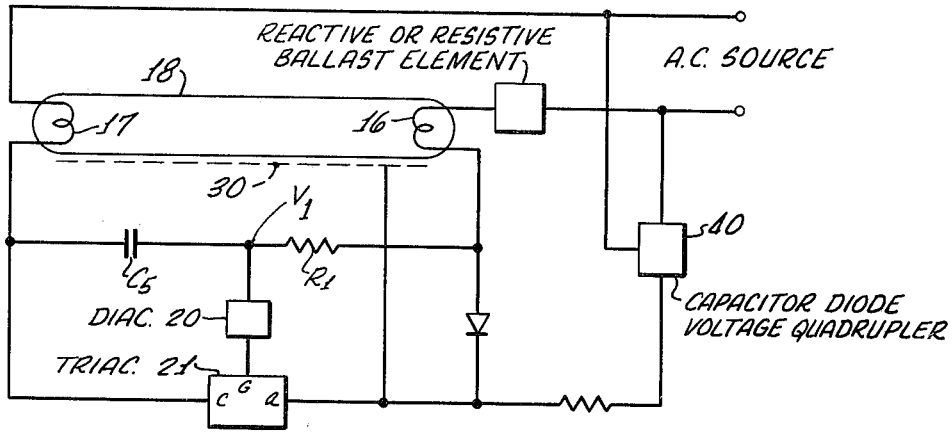
FIG. 4 shows a total non-inductive arrangement for increasing the starting potential adjacent to the lamp.

DETAILED DESCRIPTION OF A PREFERRED EMBODIMENT:

FIG. 1 shows the means by which the 60 cycle supply is non-inductively converted to a high voltage-high frequency source. It will be understood that one or more lamps (each having its own starting circuit and ballast component) could be connected to the common conversion supply (lines 11 and 12). For example, in a typical twin lamp fluorescent lighting fixture, a single ballast housing could be used to accommodate all of the components within the dotted block 10. Similarly, if a four lamp fixture were utilized, the common lines 11 and 12 would operate four identical operating circuits, and so on.

The output of the ballast supply (lines 11 and 12) is a 300 volt square wave having a frequency which is preferably within the range of 500 to 5000 cps. This waveform is generated by the rectifier doubler ($C_1$,$C_2$,$D_1$, and $D_2$) which produces a dc voltage of approximately 300 volts for 110 RMS volt AC input (or 700 volts for 220 volt AC input). The output is thus sufficient to operate four foot 1½ inch diameter 40 watt fluorescent lamps (which have an arc voltage of approximately 120 volts) from a 110 volt source, or 8 foot 1 inch diameter fluorescent lamps (which have an arc voltage of 285 volts) from a 220 volt source. The DC voltage across $C_1$ and $C_2$ is chopped by the free running multivibrator, the output of which is coupled to one or more ionized gas lamps via separate ballast components such as $Z_1$ and $Z_2$. A unique aspect of the ballast system lies in the fact that no transformers are required to step up the voltage. If capacitors are used for ballasts ($Z_1$) the relatively high frequency of the free running multivibrator the size of the capacitance required —thus smoothing the current waveform to an average value which is within the design rating of the lamp cathodes. If inductors are used for ballasts, their size, weight, and losses will be only a fraction of their corresponding 60 cycle counterpart.

Although adequate operating amplitude and frequency are achieved without the use of step-up transformers, the lamp will not start (ionize) without additional impetus. In the conventional prior art ballast, this additional impetus is provided by one of three means;

1. In a cold cathode lamp, the no load output voltage of the step-up transformer is sufficiently high to breakdown the lamp to cause ionization.

2. In a rapid start ballast, the filament windings of the transformer heat the cathode so as to reduce the amplitude of the starting potential.

3. In a preheat system the lamp is started by the inductive voltage kick generated by the opening of the starter contacts.

In all three systems, it will thus be evident that some type of transformer or series inductance is required to generate the requisite starting voltage.

The starting circuits shown in FIGS. 2, 3, and 4 eliminate the need for conventional starters and the consequent disadvantages thereof. Each of the starting circuits utilize several common elements which include a semiconductor switching element (which is preferrably a bidirectional thyrister commonly known as a triac), a breakdown trigger diode (commonly known as a diac) and a voltage responsive means (resistors $R_1$, and firing capacitor $C_5$). The circuit operates as follows: If the voltage at point $V_1$ is less than the breakover voltage of diac 20, the triac 21 will be in the non-conducting state (i.e., the impedance between the anode "*a*" and cathode "*c*" will be high). When the AC source voltage increases to a point such that the potential at $V_1$ exceeds the breakdown voltage of diac 20, the capacitor $C_5$ will be discharged into the gate terminal "*g*" of triac 21, causing it to conduct,* If the resistance $R_1$ and capacitor $C_5$ are chosen so that the start of the conduction period is midway between the zero cross-over of the applied voltage, the triac 21 will conduct during the last 50% of each half cycle. During this conduction period, current flows through the filaments 16 and 17 causing them to heat so as to ionize the gas at each end of the lamp 18. The heating of the filaments lowers the potential required to start the lamp, and thus enables striking to occur as a result of a moderate ionization field in the vicinity of the lamp. The means by which the ionization field is developed is different in each of the three embodiments shown in FIGS. 2, 3, and 4, and consequently, each will be separately described.

*Once triggered, the triac 20 continues to conduct until the applied voltage changes polarity, at which time the current flowing in the main terminals "*a*" and "*c*" extinguishes.

FIG. 2 shows a preferred embodiment for starting heated filament lamps of the type commonly used in commercial and industrial lighting applications. The mains voltage is 1st rectified and filtered by appropriate circuitry (e.g., that shown in FIG. 1) so that the applied voltage on lines 11 and 12 is a square wave having a frequency at least several times greater than 60 cycles. $R_1$ and $C_5$ are chosen so that diac 20 will breakdown midway between the zero crossover of the square wave. When triac 21 conducts during the positive half cycle (line 12 positive with respect to line 11) the full magnitude of the input voltage (less the drop across the filaments 16, 17 and the saturation resistance of the triac 21) will be applied to the radio frequency oscillator 22. The output of the R.F. oscillator 22 is coupled directly to the filament 17 of the lamp 18 via an air core transformer (primary 24 and secondary 25). The R.F. radiation field generated by the R.F. oscillator excites the gas molecules within the lamp 18 causing a moderate level of ionization over its entire length. This moderate ionization level, coupled with the local ionization produced at each end of the lamp by heating the filaments during the negative half cycle (via diode 23) is sufficient to reliable ignite the lamp. Once ignition occurs, further firing of the triac 21 is precluded because the input potential across the voltage sensing network ($R_1$ and $C_5$) is limited to the arc voltage of the lamp 18. Once started therefore, the lamp 18 operates free of all starting elements, lamp current being limited by the impedance $Z_2$ (which is preferrable a small inductor which offers a high impedance at the R.F. oscillator frequency). FIGS. 3 and 4 show starting circuits which are useful with any type of ballast element (capacitive, resistive or inductive). In these circuits, the ionization field is developed by a conducting strip 30 adjacent to the exterior surface of the lamp, thus eliminating the need for a series inductive element to isolate the supply from the source which produces the ionization field. Either circuit can be used with a 60 cycle supply (in lieu of a high frequency square wave) and both are well suited for starting fluorescent lamps which utilize incandescent lamp ballasts.*

It will be understood that a conducting strip could also be used to couple the output of the R.F. oscillator 22 (of FIG. 2) to ionize the lamp molecules, thus eliminating the necessity of coils 24 and 25, and the preference for an inductive ballast element $Z_2$.

The operation of the circuit shown in FIG. 3 is as follows: When the triac 21 fires during the positive half cycle (line 31 positive with respect to line 32) the lamp 18 is short circuited via diode $d_3$, thus heating the filaments 16 and 17. When the triac 21 conducts during the negative half cycle, the diode $d_3$ is back biased, and hence the voltage across the lamp 18 is virtually unimpaired. $C_6$ however, is charged via $R_6$ and this charge is abruptly applied to the primary winding $N_1$ (approx. 10 turns) of transformer $T_1$ causing a large voltage to be generated in the secondary winding $N_2$ (approx. 500 turns) at the instant the triac 21 impedance changes from a high value to a low value. The secondary winding $N_2$ is connected to the conducting strip 30 which has a length commensurate with the length of the lamp 18. The capacitance between the conducting strip 30 and the gas molecules within the lamp 18 imparts some of the energy of the secondary voltage spike to the molecules, causing a low level of ionization to take place over the entire length of the lamp 18. This low level of ionization, coupled with the ionization produced due to the heat generated by the filaments during the positive half cycle, is sufficient to effect reliable ignition.

An important advantage of the circuit shown in FIG. 3, lies in the fact that the primary current in transformer $T_1$ is not limited by the series impedance of the ballast. A further advantage results from the fact that the lamp 18 is not short circuited during the negative half of the input cycle—so the ionization producing voltage spike can occur when the potential across the lamp 18 is a maximum.

The circuit shown in FIG. 4 utilizes a capacitor diode voltage quadrupler 40 to provide an abrupt potential difference between the electrodes (filaments) 16 and 17, and the conductor 30. In this circuit, the anode "*a*" of the triac 21 is connected through a resistor $R_7$ to the output of the quadrupler 40, so that the anode potential (and hence the potential of conductor 30) will abruptly rise to the voltage of the quadrupler whenever triac 21 cuts off. Since this occurs when the input voltage source crosses "zero" volts, the lamp 18 will not be shorted until the next half cycle of the input source reaches a predetermined phase. With proper biasing (resistors $R_1$ and $C_5$), the time delay between the "zero" crossing and the firing of the triac will be adequate to assure sufficient lamp ionization for reliable starting. In this circuit, no inductance of any kind is required to start or operate the lamp 18.

Figure 5:
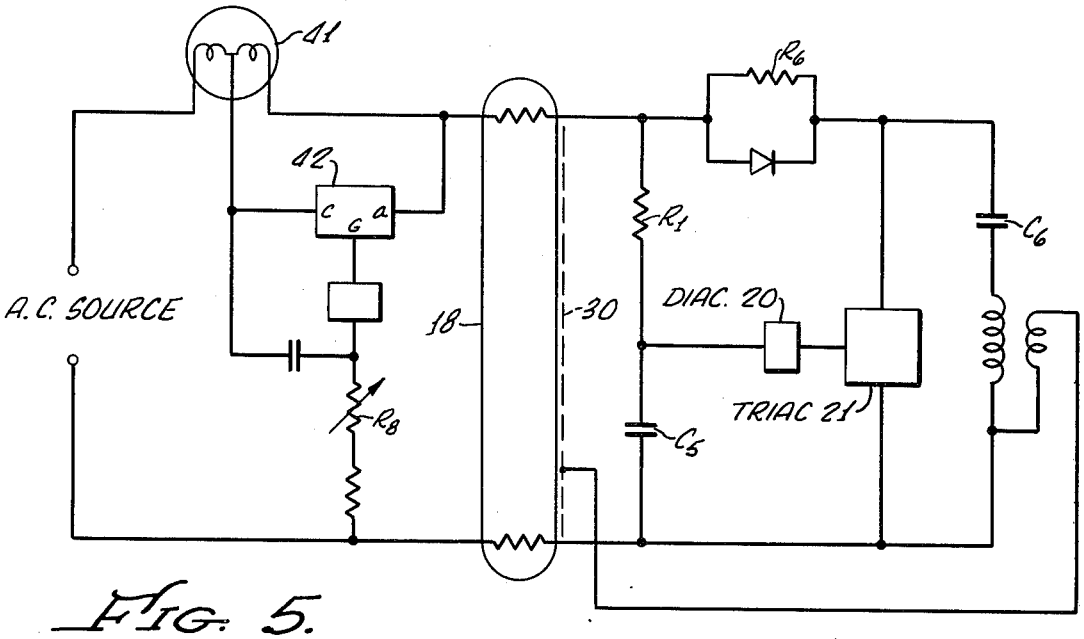
FIG. 5 shows a simplified fluorescent light dimmer, and starting arrangement.

FIG. 5 shows another application of the starting circuit shown in FIG. 3. In this embodiment, a three-way light bulb (incandescent lamp) 41 is utilized as a variable impedance ballast element. By varying $R_8$, the firing point of triac 42 can be adjusted so as to control the brightness of the fluorescent lamp 18. The circuit is particularly applicable to household table lamps which can easily be modified to utilize a 32 watt circline fluorescent lamp to provide the same light output as a conventional 100 watt incandescent light bulb. An important advantage of the circuit lies in the fact that the variable resistor $R_8$ need not be returned to a particular value when the lamp is switched "off" from a remote location. Starting can be accomplished with $_8$ set for minimum intensity, since, prior to starting, the full potential will appear across lamp 18 causing triac 42 to fire at a sufficiently early phase to effectively lower the impedance in series with the lamp during starting.

Although the basic concept of the invention is concerned with a low loss ballast system, the starting circuits, are of themselves, conceptually novel in that they produce a prestarting ionization field without employing step-up or inductive kick transformers or ballasts which conventionally operate from the line voltage — or remain series connected after lamp ignition occurs. It will thus be evident that the starting circuits are equally applicable to conventional prior art ballasts, as well as the unique ballast system discussed herein. Nor are the basic concepts of the ballast and starting circuits limited to the particular circuits and exemplary applications shown. Thus, although preferred embodiments of ballasts and starting circuits have been shown and described, it will be understood that the invention is not limited thereto, and that numerous changes, modifications, and substitutions may be made without departing from the spirit of the invention.

We claim:

1. A system for operating an ionized gas lamp of the type having a pair of heated filament electrodes comprising:

capacitor-rectifier doubler means operatively connected to an A.C. source for producing a D.C. potential equal to the peak-to-peak voltage of the A.C. source;

bidirectional chopper means operatively connected to the output of said capacitor-rectifier doubler for alternately switching the potential across the gas lamp between said D.C. potential and the reference by which it is measured so as to produce a rectangular wave having a frequency at least twice that of the frequency of the A.C. source;

impedance means operatively connected in series between the output of said chopper means and one of said gas lamp filament electrodes, said impedance means having a value in accordance with the frequency of said chopper means sufficient to limit the current in the ionized gas lamp to a predetermined rated value;

circuit means operatively connected across said gas lamp filament electrodes for heating said filaments and producing an overall ionization field during starting; said circuit means comprising voltage responsive means operatively connected across the electrode of the gas lamp for producing a potential having a magnitude which is dependent upon the state of the gas lamp; and starting means operatively connected to said voltage responsive means for heating the filaments of the lamp and for producing an ionization field within the gas lamp prior to starting.

2. The apparatus recited in claim 1 wherein said circuit means for heating the filament of the lamp comprises:

a three electrode semiconductor switching element having two main electrodes operatively connected to said filaments of the gas lamp so as to cause current to flow in said filaments whenever said semiconductor switch changes from a high impedance to a low impedance and, a gate electrode operatively connected to said voltage responsive means so as to cause the impedance between the main electrodes of said semiconductor switching element to change from a high impedance to a low impedance when the voltage across the filaments reaches a predetermined point.

3. The apparatus recited in claim 2 wherien said means for producing an overall ionization of the lamp comprises:

means for generating a radio frequency electromagnetic field and;

means for coupling the output of said field generating means to an electrode of said lamp.

4. The apparatus recited in claim 1 wherein said means for producing an overall ionization field within the lamp comprises:

means for generating a time varying potential difference in the proximity of the surface of the lamp relative to either electrode of the lamp.

5. The apparatus recited in claim 4 wherein said means for generating a time varying potential difference in the proximity of the surface of the lamp comprises:

a capacitor having one terminal connected to one of the main electrodes of said semiconductor switching element;

a pulse transformer having a primary and a secondary winding wherein one terminal of the primary winding is operatively connected to the other terminal of said capacitor, and the other primary winding terminal is operatively connected to the other main electrode of said semiconductor switching element, and wherein one terminal of the secondary winding is operatively connected to a conductive surface adjacent to the surface of the lamp, and the other terminal of the secondary winding is operatively connected to a main electrode of said semiconductor switching element to provide a reference with respect to the primary of said pulse transformer.

6. A circuit for starting and operating an ionized gas lamp of the type having a pair of heated filament electrodes comprising:

a ballast impedance operatively connected in series between one terminal of an A.C. source and a 1st terminal of the 1st electrode of an ionized gas lamp;

means for connecting the 1st terminal of the 2nd lamp electrode to the A.C. source;

a bidirectional switching element having a pair of main electrodes and a gate electrode for applying a current to cause the impedance between the main electrodes to change from a high impedance state to a low impedance state;

rectifier means operatively connected in series between a main electrode of said bidirectional switching element and a 2nd terminal of the first electrode of the ionized gas lamp;

means for connecting the other main electrode of said bidirectional switching element to a 2nd terminal of the 2nd electrode of the ionized gas lamp;

voltage responsive means operatively connected across the electrodes of the ionized gas lamp.

triggering means operatively connected to said voltage responsive means and the gate electrode of said bidirectional switching element for causing said bidirectional switching element to change from a high impedance to a low impedance at some point during each cycle of the A.C. source prior to the time the ionized gas lamp starts, and for inhibiting said bidirectional switching element from changing from a high impedance to a low impedance after the ionized gas lamp starts;

voltage step-up means operatively connected to the main electrode of said bidirectional switching element for producing a prestarting ionization field adjacent to the surface of the lamp when said bidirectional switching element changes from a high impedance to a low impedance.

7. The apparatus recited in claim 6 wherein said voltage step up means comprises:

a pulse transformer;

a capacitor;

means for connecting the primary of said pulse transformer and said capacitor in series across the main electrodes of said bi-directional switching element;

impedance means connected to said capacitor for charging said capacitor to a value commensurate with the peak value of the A.C. source;

means for referencing one terminal of said pulse transformer secondary to the primary of said pulse transformer;

means for connecting the other terminal of the pulse transformer secondary to a conductor which is positioned to effect an ionization field as a result of the potential developed between the lamp electrodes and said conductor each time said bidirectional switching element changes from a high impedance to a low impedance.

8. The apparatus recited in claim 6 wherein said ballast comprises an incandescent lamp having two filaments, and wherein is included:

semiconductor switching means having a pair of main electrodes operatively connected in parallel with one filament of said incandescent lamp, and a gate electrode for changing the impedance between main electrode;

biasing means operatively connected across the electrodes of said ionized gas lamp and to the gate electrode of said semiconductor switching means; said biasing means including:

a variable resistor for adjusting the firing point of said semiconductor switching element whereby the average value of the ballast impedance may be varied to control the brightness of the ionized gas lamp.

9. A starting system for a heated filament electrode fluorescent lamp employing a non-inductive current limiting ballast impedance which is series connected between one electrode of the lamp and an A.C. source, said starting system comprising:

a conductor adjacent to the surface of the fluorescent lamp;

a bidirectional semiconductor switching means;

biasing means operatively connected across the electrodes of the lampm, and to said bidirectional semiconductor switching means for causing said bidirectional semiconductor switching means to change from a high impedance to a low impedance at some point during each half cycle of the A.C. source prior to the time the lamp starts;

a rectifier;

means for operatively connecting said rectifier and said bidirectional switching means in series across the filaments of said lamp so as to cause a heating current to flow through both filaments whenever the impedance of said semiconductor switching means changes from a high value to a low value during a 1st half cycle of the A.C. source only, and;

a capacitor;

a step-up pulse transformer;

means for series connecting the primary of said pulse transformer and said capacitor across said semiconductor so as to cause the charge on said capacitor to be applied to the primary of said pulse transformer whenever said semiconductor switching means changes from a high impedance to a low impedance during the other half cycle of the A.C. source;

impedance means operatively connected to said capacitor for charging said capacitor prior to that time in the A.C. cycle at which said semiconductor switching means changes from a high impedance to a low impedance;

means for connecting the secondary of said pulse transformer to said conductor adjacent to the surface of the lamp whereby the potential between said conductor and at least one electrode will abruptly change when said semiconductor switching means changes from a high impedance to a low impedance.

* * * * *

UNITED STATES PATENT AND TRADEMARK OFFICE

CERTIFICATE OF CORRECTION

PATENT NO. : 4,117,377

DATED : Sept. 26, 1978

INVENTOR(S) : Bruce D. Jimerson et al.

It is certified that error appears in the above–identified patent and that said Letters Patent are hereby corrected as shown below:

On the title page in item [76], the following should be added:

-- Marvin G. Yim, 2730 Rainbow Ridge Rd.
Rancho Palos Verdes, Calif. 90274 --.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*